US006737908B2

(12) United States Patent
Mottola et al.

(10) Patent No.: US 6,737,908 B2
(45) Date of Patent: May 18, 2004

(54) BOOTSTRAP REFERENCE CIRCUIT INCLUDING A SHUNT BANDGAP REGULATOR WITH EXTERNAL START-UP CURRENT SOURCE

(75) Inventors: Michael J. Mottola, San Jose, CA (US); Karl M. Schlager, Campbell, CA (US)

(73) Assignee: Micrel, Inc., San Jose, CA (US)

( * ) Notice: Subject to any disclaimer, the term of this patent is extended or adjusted under 35 U.S.C. 154(b) by 0 days.

(21) Appl. No.: 10/233,883

(22) Filed: Sep. 3, 2002

(65) Prior Publication Data

US 2004/0041551 A1 Mar. 4, 2004

(51) Int. Cl.[7] ..... G05F 1/10
(52) U.S. Cl. ..... 327/539; 323/901; 327/589
(58) Field of Search ..... 323/313–316, 323/901; 327/538, 539, 589

(56) References Cited

U.S. PATENT DOCUMENTS 4,447,784 A 5/1984 Dobkin ..... 323/226
5,668,467 A * 9/1997 Pease ..... 323/315
5,856,742 A * 1/1999 Vulih et al. ..... 323/315
6,005,374 A 12/1999 Tasdighi ..... 323/273
6,016,051 A 1/2000 Can ..... 323/315
6,150,872 A 11/2000 McNeill et al. ..... 327/539
6,181,196 B1 1/2001 Nguyen ..... 327/539
6,285,244 B1 9/2001 Goldberg ..... 327/539

* cited by examiner

*Primary Examiner*—Shawn Riley
(74) *Attorney, Agent, or Firm*—Patent Law Group LLP; Carmen C. Cook

(57) ABSTRACT

A bootstrap reference circuit includes a shunt regulator for generating a reference voltage at a first node, a current source generating a current, and a current mirror coupling the current to the shunt regulator for supplying the shunt regulator. In operation, when the shunt regulator is powering up, the current has an increasing magnitude when a voltage at the first node is less than a predefined voltage value where the predefined voltage value is less than the reference voltage. Furthermore, the current has a decreasing magnitude when the voltage at the first node is greater than the predefined voltage value. In one embodiment, the shunt regulator includes a bandgap reference circuit and the predefined voltage value is less than the bandgap voltage of 1.24 volts.

22 Claims, 3 Drawing Sheets

BOOTSTRAP REFERENCE CIRCUIT INCLUDING A SHUNT BANDGAP REGULATOR WITH EXTERNAL START-UP CURRENT SOURCE

FIELD OF THE INVENTION

The invention relates to a bootstrap reference circuit and, in particular, to a bootstrap reference circuit using a shunt regulator biased by a peaking current source for achieving high supply rejection ratio and zero temperature coefficient.

DESCRIPTION OF THE RELATED ART

Electronic circuits often require a voltage reference that is stable and substantially constant over temperature and power supply variations. A bandgap reference circuit is typically used to generate such a temperature-independent and power-supply-independent reference voltage. A bandgap reference circuit generates a bandgap voltage of 1.24 volts by developing a first voltage related to a multiple of the base-to-emitter voltage differential ($\Delta V_{BE}$) of a pair of transistors operating at different current densities and a second voltage related to the base-to-emitter voltage $V_{BE}$of a third transistor. The first voltage $\Delta V_{BE}$ is proportional to absolute temperature (PTAT) and thus has a positive temperature coefficient. On the other hand, the second voltage $V_{BE}$ has a negative temperature coefficient. Thus, the sum of $K\Delta V_{BE}$ (where K is a multiple) and the base-to-emitter voltage $V_{BE}$ produces a voltage that has nearly no temperature dependence and no power-supply dependence. An example of a bandgap voltage reference circuit is described in U.S. Pat. No. 4,447,784, which patent is incorporated herein by reference in its entirety.

In electronic circuits including high gain circuit components, it is important for the reference voltage to have a high power supply rejection ratio (PSRR). One method of providing a reference voltage with high PSRR is to use a bandgap reference circuit as a shunt regulator. The bandgap voltage, at 1.24 volts, is bootstrapped to the desired voltage for powering the designated circuits. The most common method to supply current to such a bandgap, reference shunt regulator is to use a PTAT/R current. The PTAT/R current is derived from applying a PTAT voltage, such as the $\Delta V_{BE}$ voltage of the bandgap reference circuit, to a resistor R.

The conventional method of providing a high PSRR voltage reference has several shortcomings. First, because the bootstrap current (that is, the PTAT/R current) is "bounced off" the power supply voltage through the resistor R, the bootstrap current increases as the bandgap voltage increases. As a result, as the bandgap reference circuit is powering up, the bandgap reference circuit is destabilized because of positive feedback from the bootstrap current. Even with this positive feedback, the conventional bandgap reference circuit will still be able to regulate because the gain of the amplifier in the bandgap reference circuit is typically capable of overcoming the gain of the bootstrap current. However, increased compensation capacitance has to be added to stabilize the bandgap reference circuit which has the effect of slowing down the response of the bandgap reference circuit.

Therefore, a reference circuit capable of achieving high PSRR without the aforementioned disadvantages is desired.

SUMMARY OF THE INVENTION

According to one embodiment of the present invention, a circuit includes a shunt regulator for generating a reference voltage at a first node, a current source generating a current, and a current mirror coupling the current to the shunt regulator for supplying the shunt regulator. In operation, when the shunt regulator is powering up, the current has an increasing magnitude when the voltage at the first node is less than a predefined voltage value where the predefined voltage value is less than the reference voltage. Furthermore, the current has a decreasing magnitude when the voltage at the first node is greater than the predefined voltage value.

In one embodiment, the shunt regulator includes a bandgap reference circuit and the reference voltage is a bandgap voltage. In this case, the predefined voltage value can be set to 1 volt.

According to one embodiment of the present invention, the current source includes a first resistor coupled between the first node and a second node, a second resistor coupled between the second node and a third node, a first transistor having a first current handling terminal coupled to the third node, a second current handling terminal coupled to a first supply voltage, and a control terminal coupled to the second node, and a second transistor having a first current handling terminal coupled to generate the current, a second current handling terminal coupled to the first supply voltage, and a control terminal coupled to the third node.

According to one aspect of the present invention, the predefined voltage value at which the current generated by the current source has a peak value is established by the resistance of the first and second resistors. Specifically, when the current has a peak current value equaling to $V_T/R2$, where $V_T$ is the thermal voltage (kT/q) and R2 is the resistance of the second resistor, the predefined voltage value is the sum of a voltage at the second node and a voltage across the first resistor at the peak current value.

The present invention is better understood upon consideration of the detailed description below and the accompanying drawings.

DETAILED DESCRIPTION OF THE PREFERRED EMBODIMENTS

In accordance with the principles of the present invention, a bootstrap reference circuit includes a shunt regulator for generating a reference voltage and a peaking current source for supplying current to the shunt regulator. The peaking current source is powered by the reference voltage and supplies an increasing current to provide a feedforward gain as the bootstrap reference circuit is powering up. As the shunt regulator of the bootstrap reference circuit approaches regulation where the regulated voltage approaches the final reference voltage value, the peaking current source transitions to supply a decreasing current to provide a negative feedback. The operation of the peaking current source improves the stability of the bootstrap reference circuit, preventing voltage overshoots that can occur as the shunt regulator reaches regulation. The bootstrap reference circuit of the present invention can realize a very high power supply rejection ratio and can be applied effectively in high gain circuits.

Figure 1:
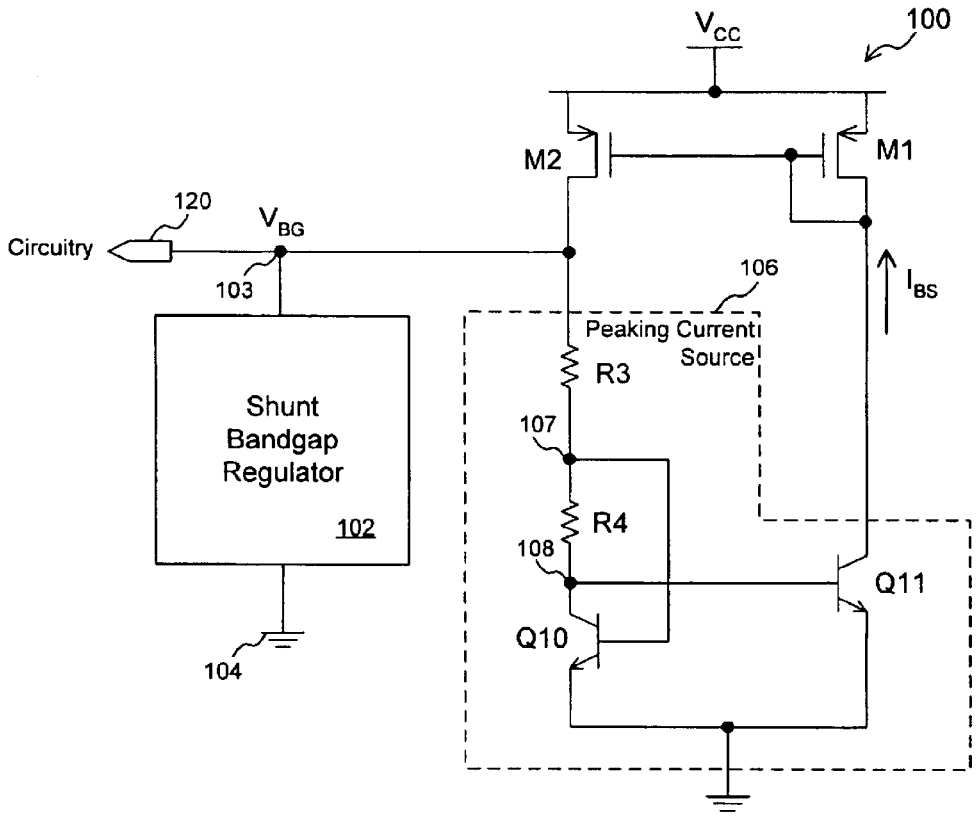
FIG. 1 is a circuit diagram of a bootstrap reference circuit according to one embodiment of the present invention.

FIG. 1 is a circuit diagram of a bootstrap reference circuit according to one embodiment of the present invention. Referring to FIG. 1, bootstrap reference circuit 100 includes a shunt regulator 102 for generating a reference voltage, a peaking current source 106 for generating a bootstrap current $I_{BS}$, and a current mirror for coupling the bootstrap current $I_{BS}$ to shunt regulator 102. In the present description, a shunt regulator refers to a two-terminal device where a fixed reference voltage develops across the two terminals when current is supplied to the terminals. In one embodiment, shunt regulator 102 of bootstrap reference circuit 100 is implemented as a voltage reference circuit including a first terminal 103 generating the reference voltage and a second terminal 104 coupled to the ground potential.

In the present embodiment, shunt regulator 102 is implemented using a bandgap reference circuit and is thus referred to in FIG. 1 as a shunt bandgap regulator. When current is supplied to terminal 103 of shunt bandgap regulator 102, a bandgap voltage $V_{BG}$ of about 1.24 volts develops across terminals 103 and 104 of the shunt bandgap regulator. Bandgap reference circuits are known in the art and shunt bandgap regulator can be implemented using any conventional bandgap reference circuits. In the following description, the term "bandgap reference circuit" will be used interchangeably with "shunt bandgap regulator" to refer to shunt regulator 102 of bootstrap reference circuit 100.

Bootstrap reference circuit 100 realizes improved PSRR by powering the bandgap reference circuit (regulator 102) off the bandgap voltage $V_{BG}$ itself. Therefore, the bandgap reference circuit is isolated from perturbations in the Vcc power supply rail. However, to facilitate the operation of the bandgap reference circuit, a large current must be supplied to the bandgap reference circuit sufficient to power up the bandgap reference circuit itself. Thus, bootstrap reference circuit 100 includes peaking current source 106 for generating a bootstrap current $I_{BS}$ which current is used to supply shunt bandgap regulator 102. Referring to FIG. 1, current $I_{BS}$ generated by peaking current source 106 is mirrored by a current mirror formed by PMOS transistors M1 and M2. In this manner, bootstrap current $I_{BS}$ generated by the peaking current source is coupled to terminal 103 of shunt bandgap regulator 102 and provides the necessary current to support the operation of the shunt regulator.

The current generated by peaking current source 106 has to meet the current demand of the bandgap reference circuit and the peaking current source itself. The current demand of the bandgap reference circuit and the peaking current source is a PTAT/R current, where PTAT denotes a voltage proportional to absolute temperature. Thus, peaking current source 106 needs to supply a PTAT/R current to shunt bandgap regulator 102 and the peaking current source itself to match the current demand and to match any variations in the current demand over process and operational temperature variations.

Referring to FIG. 1, peaking current source 106 includes a resistor R3, a resistor R4 and an NPN transistor Q10 connected in series between terminal 103 (the reference voltage $V_{BG}$ terminal) and the ground potential. Specifically, the collector terminal (node 108) of transistor Q10 is connected to resistor R4 and the emitter terminal of transistor Q10 is connected to the ground potential. The base terminal of transistor Q10 is connected to the intermediate node between resistor R3 and R4 (node 107). The ratio of the resistance between resistors R3 and R4 and the value of the resistance of resistors R3 and R4 establish the magnitude of the current generated by the peaking current source, as will be described in more detail below.

Peaking current source 106 further includes an NPN transistor Q11. The base terminal of transistor Q11 is coupled to the collector terminal of transistor Q10 (node 108). The emitter terminal of transistor Q11 is coupled to the ground potential while the collector terminal of transistor Q11, generating the bootstrap current $I_{BS}$, is coupled to transistor M1 which forms a current mirror with transistor M2. In operation, the voltage at the collector terminal of transistor Q10 (node 108) establishes the operating point of transistor Q11 and thus controls the bootstrap current that is delivered by transistor Q11 at its collector terminal. In the present embodiment, the ratio of transistor Q10 to transistor Q11 is 1:5. However, the ratio is not critical to the operation of the peaking current source and is selected based on the current demand of the bandgap reference circuit and the W/L ratio of transistor M1 to transistor M2.

The bootstrap current $I_{BS}$ generated by peaking current source 106 is coupled to the current mirror formed by transistors M1 and M2. The source terminals of transistors M1 and M2 are coupled to the power supply voltage Vcc. The drain terminal of transistor M1 is coupled to the gate terminals of transistors M1 and M2 and also coupled to the collector terminal of transistor Q11 receiving the bootstrap current. The drain terminal of transistor M2 is coupled to terminal 103 providing the mirrored bootstrap current $I_{BS}$ to shunt bandgap regulator 102 and to peaking current source 106.

Figure 2:
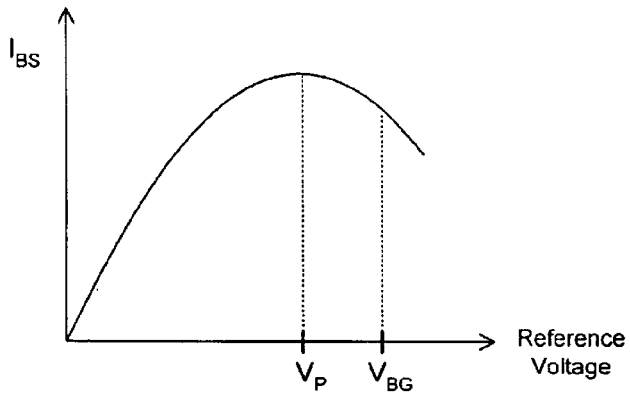
FIG. 2 is a plot illustrating behavior of the bootstrap current $I_{BS}$ generated by the peaking current source versus the reference voltage of the shunt bandgap regulator in the bootstrap reference circuit according to one embodiment of the present invention.

In operation, peaking current source 106 generates a bootstrap current $I_{BS}$ that is initially increasing but begins to decrease prior to the shunt regulator reaching regulation. The behavior of the bootstrap current $I_{BS}$ with respect to the reference voltage at terminal 103 of shunt bandgap regulator 102 is illustrated in FIG. 2. By providing a bootstrap current that is decreasing as the shunt bandgap regulator reaches regulation, the bootstrap current provides a negative feedback to the shunt bandgap regulator which has the effect of stabilizing the regulator circuit.

Referring to FIG. 2, as the bandgap reference circuit is powering up and the reference voltage (at terminal 103) is increasing towards the final bandgap voltage $V_{BG}$, the bootstrap current $I_{BS}$ generated by peaking current source 106 is increasing. But at a point prior to the reference voltage reaching the final regulated voltage value (i.e., the bandgap voltage $V_{BG}$), the peaking current source generates a decreasing bootstrap current $I_{BS}$. Thus, the bootstrap current $I_{BS}$ peaks at a voltage $V_P$ that is less than the final reference voltage value of the bandgap reference circuit.

The operation of peaking current source 106 to generate a current that peaks at a voltage near the final reference voltage value is as follows. As the bandgap reference circuit (shunt bandgap regulator 102) is powering up and the reference voltage at terminal 103 is low, transistors Q10 and Q11 are turned off. However, as the reference voltage rises, transistors Q10 and Q11 begin to turn on lightly. As the reference voltage continues to increase, the voltage at node 107 acts to turn on transistor Q10. As transistor Q10 turns on, transistor Q10 regulates the current increase of transistor Q11.

Specifically, the resistances of resistors R3 and R4 are selected so that at the critical voltage $V_P$ less than the bandgap voltage $V_{BG}$, transistor Q11 is conducting the maximum current. When the reference voltage is less than the critical voltage $V_P$, transistor Q11 is not fully turned on and the bootstrap current conducting through transistor Q11 increases as the reference voltage increases. When the reference voltage exceeds the critical voltage $V_P$, transistor Q10 is turned on fully and has the effect of turning off transistor Q11. As a result, the current conducting through transistor Q11 peaks at the critical voltage $V_P$ and decreases as the reference voltage increases beyond the critical voltage $V_P$.

As described above, the ratio of the resistances of resistors R3 and R4 sets the critical voltage $V_P$ at which the bootstrap current $I_{BS}$ peaks. In the present embodiment, the peak current value is selected to be $V_T/R_4$, where $V_T$ is the thermal voltage (kT/q) and is proportional to absolute temperature and $R_4$ denotes the resistance of resistor R4. The resistance values for resistors R3 and R4 can be determined as follows. First, a resistance value for resistor R4 is selected and the peak current is calculated accordingly using the formula: peak current=$V_T/R_4$. The resistance value for resistor R3 is selected so that, at the peak current, the sum of the base-to-emitter voltage $V_{BE}$ of transistor Q10 and the voltage across resistor R3 is the critical voltage $V_P$.

The use of a peaking current as the bootstrap current in the bootstrap reference circuit of the present invention has several advantages. First, the decreasing bootstrap current $I_{BS}$ helps stabilize the bandgap reference circuit by minimizing possible voltage overshoots when the bandgap reference circuit reaches regulation. Second, the decreasing bootstrap current $I_{BS}$ also makes compensation of the bandgap reference circuit easier by increasing the phase margin of the bandgap reference circuit and allowing the bandgap reference circuit to power up more quickly. Specifically, as the bandgap reference circuit is powering up, peaking current source 106 supplies a high current which realizes a large feedforward gain. The large feedforward gain helps the bandgap reference circuit to power up more quickly. However, the peaking current source transitions to decreasing current realizing a negative feedback prior to the bandgap reference circuit reaching its final regulated voltage so that the stability of the reference circuit is enhanced.

Another feature of bootstrap reference circuit of the present invention involves the use of MOS transistors as the current mirror to connect the bootstrap current $I_{BS}$ to the shunt bandgap regulator. Conventional bootstrap reference circuits typically use lateral bipolar PNP transistors to construct the current mirrors. A current mirror built using bipolar PNP transistor is undesirable because bipolar transistors can have significantly large base to substrate capacitance, introducing a significant amount of capacitance from the base to the ground potential. As a result, if there is positive transient on the Vcc power supply rail, the positive transient tends to turn on the bipolar transistor current mirror and cause the bandgap voltage to increase. Moreover, a lateral PNP transistor tends to be very slow device and is not suitable for high speed operations. Although vertical PNP transistors can be used to build the current mirror, vertical PNP transistors involve more complex processing steps and are thus most costly to build. Therefore, vertical PNP transistors are undesirable.

When MOS transistors are used to construct the current mirror, the gate to drain capacitance is very small, thereby eliminating the problems caused by capacitive coupling between the drain and gain terminals. Furthermore, MOS transistors are typically faster and have better rejection of high frequency noise on the power supply rail.

The bootstrap reference circuit of the present invention is capable of providing a reference voltage with a high PSRR and zero temperature coefficients. Thus, the bootstrap reference circuit of the present invention can be used in applications where a temperature-independent and power supply-independent reference voltage is required. For instance, the bootstrap reference circuit of the present invention can function as a power supply for circuitry on an integrated circuits requiring a low power supply voltage. For instance, bootstrap reference circuit 100 of FIG. 1 generates a reference voltage of about 1.24 volts. The reference voltage can be coupled to designated circuitry on a terminal 120 to function as the power supply for the designated circuitry. Furthermore, the bandgap voltage of 1.24 volts can be stepped up or stepped down to a desired level to provide a low power supply voltage.

Figure 3:
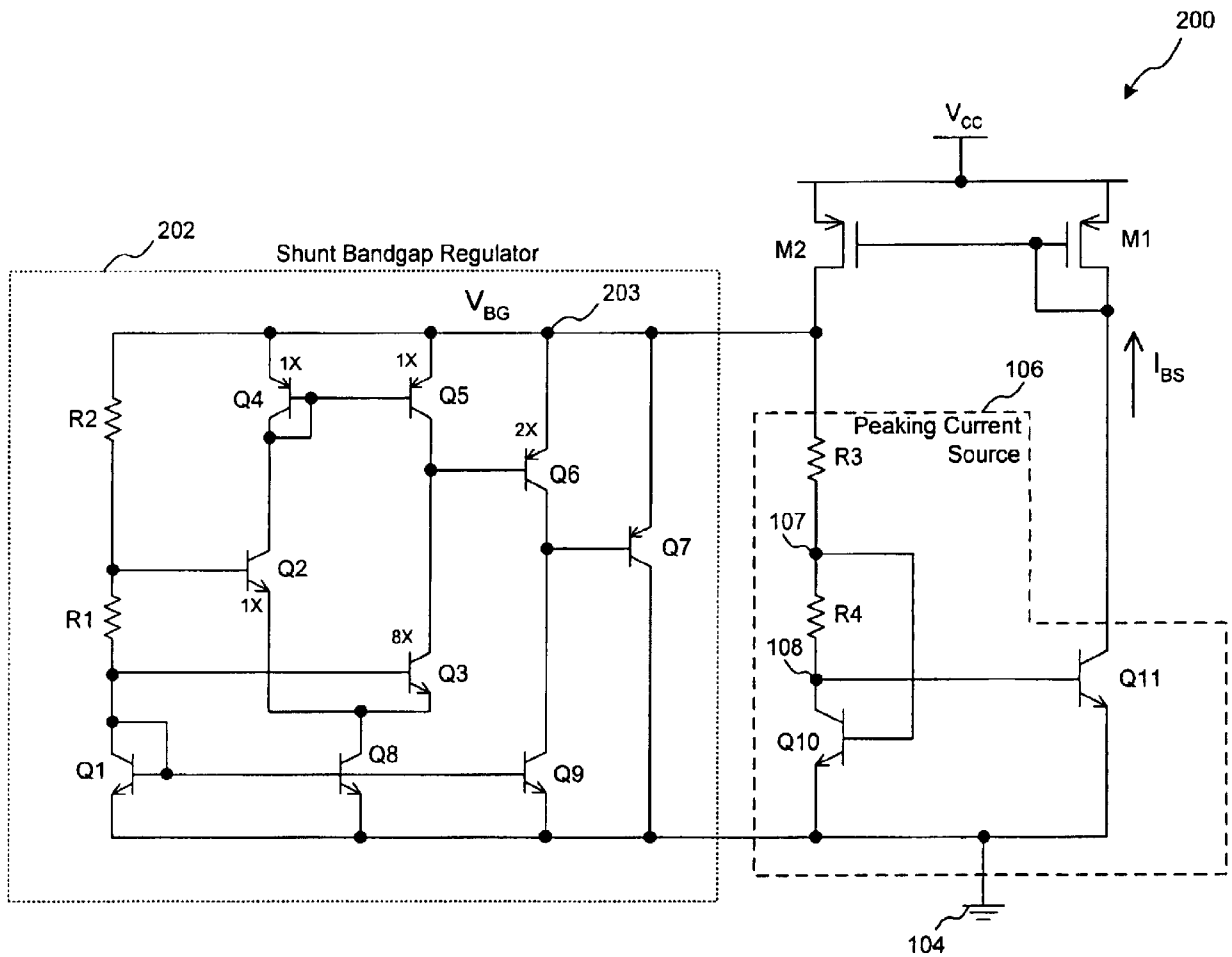
FIG. 3 is a circuit diagram of a bootstrap reference circuit according to another embodiment of the present invention.

FIG. 3 is a circuit diagram of a bootstrap reference circuit according to another embodiment of the present invention. FIG. 3 illustrates the implementation of the bootstrap reference circuit 200 of the present invention using a bandgap reference circuit 202 as the shunt regulator. Like elements in FIGS. 1 and 3 are given like reference numerals to simplify the discussion.

Referring to FIG. 3, bandgap reference circuit 202 includes an NPN transistor Q1 generating a base-to-emitter voltage $V_{BE}$ having a negative temperature coefficient. Bandgap reference circuit 202 further includes a differential amplifier formed by NPN transistors Q2 and Q3 generating a $\Delta V_{BE}$ voltage and PNP transistors Q4 and Q5 forming a current mirror. The sizes of transistors Q2 and Q3 are ratioed so as to create different current densities through each transistors. As a result, transistors Q2 and Q3 generate a $\Delta V_{BE}$ voltage which is developed across a resistor R1. In the present embodiment, the size ratio of transistor Q2 to transistor Q3 is 1:8. The $\Delta V_{BE}$ voltage is multiplied by the ratio of the resistance of resistors R1 and R2 and added to voltage $V_{BE}$ to generate the bandgap voltage $V_{BG}$ at node 203. In this manner, a reference voltage having near zero temperature coefficient is generated.

PNP transistors Q4 and Q5 form a current mirror for providing a load to transistors Q2 and Q3. Because the base terminals of transistors Q4 and Q5 are both connected to the collector terminal of transistor Q4, the collector current of transistor Q2 is increased by the sum of the base current of transistors Q4 and Q5, resulting in a current error of two times the base current (i.e., $2I_B$). To correct for this error and to provide an additional voltage amplification in bandgap reference circuit 202, a second amplifier stage including PNP transistor Q6 and NPN transistor Q9 is included in bandgap reference circuit 202. The additional gain stage provided by transistors Q6 and Q9 helps to improve the accuracy of the bandgap voltage and helps to lower the output impedance of the bandgap reference circuit which in turn improves the power supply rejection ratio.

In operation, when the emitter currents at transistors Q4 and Q5 are each I, the collector current at transistor Q2 is $I+I_B$ while the collector current at transistor Q3 is $I-I_B$. Thus, a $2I_B$ current error is introduced between the two branches of the differential amplifier. Transistor Q6 is sized so as to draw an emitter current of 2I. As a result, transistor Q6 provides a base current of $2I_B$ to the collector terminal of transistor Q3, correcting the $2I_B$ current error. In the present embodiment, transistors Q4 and Q5 are equally sized while transistor Q6 is sized two times larger than transistors Q4 and Q5.

Bandgap reference circuit 202 further includes a PNP transistor Q7 functioning as an emitter follower. Transistor Q7 is a current buffer stage for providing a high gain output and for sinking additional bootstrap current $I_{BS}$. Sinking of an additional bootstrap current $I_{BS}$ is necessary to ensure the regulation of the bandgap voltage $V_{BG}$.

In actual implementation, bootstrap reference circuit 200 will further include a start-up circuit (not shown) to get the bandgap reference circuit and the bootstrap reference circuit started. Start-up circuits for bandgap reference circuits are well known in the art.

In one embodiment of the present invention, the collector current flowing through transistor Q1 is set to be a large value as compared to the currents flowing through the differential amplifier (transistors Q2 and Q3) and the second gain stage (transistors Q6 and Q9). The larger collector current for transistor Q1 ensures that sufficient base currents are provided to transistors Q2 and Q3. Furthermore, because transistor Q9 draws base current from transistor Q1, the use of a larger collector current at transistor Q1 obviates any voltage error that may be introduced to the $V_{BE}$ voltage (across transistor Q1) due to transistors Q8 and Q9 drawing base current from transistor Q1. In one embodiment, the collector current at transistor Q1 is 24 $\mu$A, the collector currents at transistors Q2 and Q3 are each 3 $\mu$A and the collector current at transistor Q9 is 6 $\mu$A.

The operation of bootstrap reference circuit 200 is analogous to bootstrap reference circuit 100 of FIG. 1. As bandgap reference circuit 202 is powering up and the reference voltage at node 203 is increasing towards the bandgap voltage, peaking current source 106 generates an increasing bootstrap current $I_{BS}$ to supply the bandgap reference circuit 202. As the reference voltage approaches the final bandgap voltage $V_{BG}$ of 1.24 volts, the bootstrap current $I_{BS}$ peaks and starts to decrease. In one embodiment, the bootstrap current $I_{BS}$ is set to peak when the reference voltage is about 1 volt. When bandgap reference circuit 202 reaches regulation, peaking current source 106 generates a decreasing bootstrap current $I_{BS}$ which provides negative feedback and helps to improve the stability of the bootstrap reference circuit.

Figure 4:
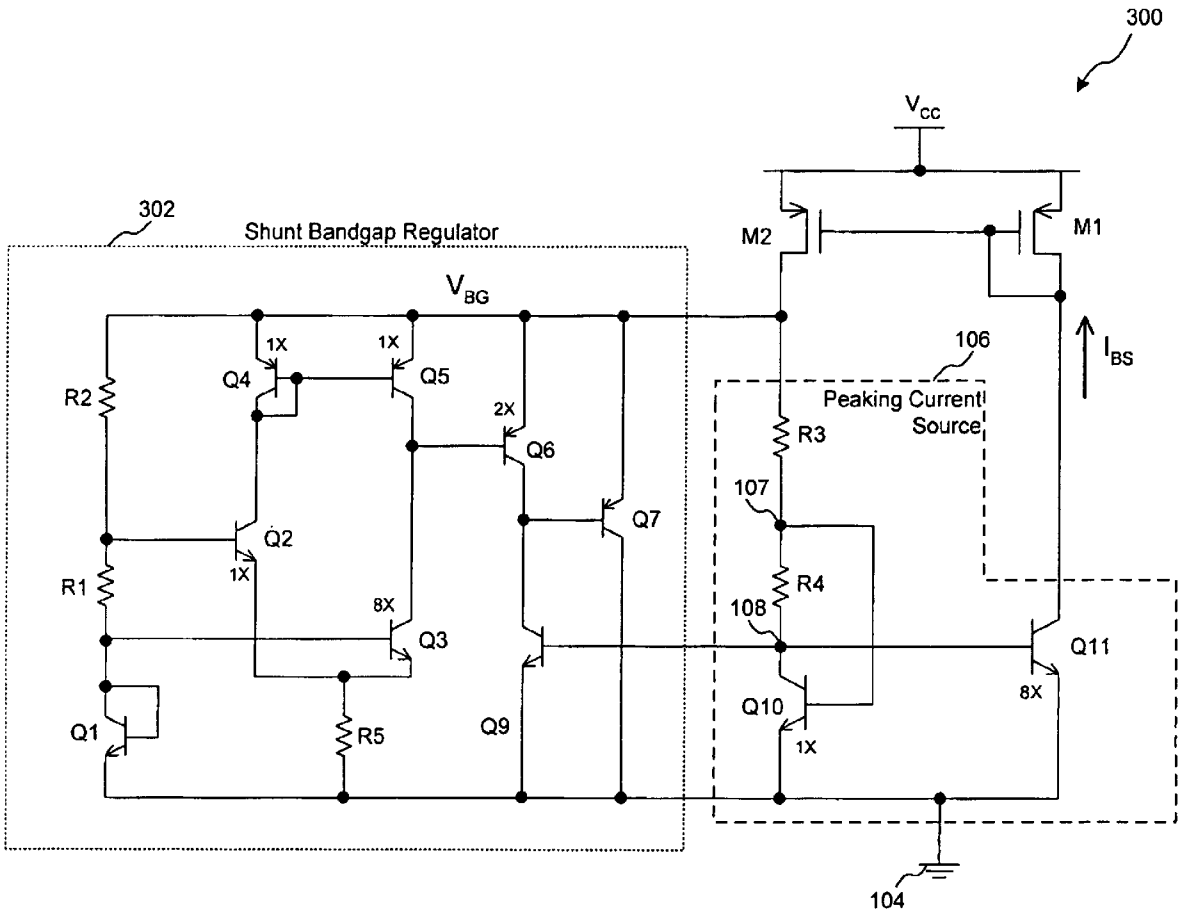
FIG. 4 is a circuit diagram of a bootstrap reference circuit according to an alternate embodiment of the present invention.

FIG. 4 is a circuit diagram of a bootstrap reference circuit according to an alternate embodiment of the present invention. Like elements in FIGS. 3 and 4 are given like reference numerals to simplify the discussion. FIG. 4 illustrates alternative configuration of the bandgap reference circuit for improving the performance of the bandgap reference circuit.

Returning to FIG. 3, transistors Q8 and Q9 both draw base currents from transistor Q1. The base current drawn by transistors Q8 and Q9 may affect the voltage $V_{BE}$ of transistor Q1 and ultimately, may introduce temperature variations in the bandgap voltage because base current varies with temperature.

In the embodiment shown in FIG. 4, transistor Q1 is not used to bias any other transistors in the bandgap reference circuit. Thus, as shown in FIG. 4, transistor Q1 is only used to generate the voltage $V_{BE}$ to be summed with the $\Delta V_{BE}$ voltage. Instead, the differential amplifier of transistors Q2 and Q3 is biased by a resistor R5. In another embodiment, the differential amplifier of transistors Q2 and Q3 can be biased by a transistor not powered off transistor Q1. Furthermore, the base terminal of transistor Q9 is coupled to node 108 of peaking current source 106. Transistor Q9 thus draws its base current from the PTAT/R current of the peaking current source.

In the embodiment shown in FIG. 4, resistors R3 and R4 are selected so that when the bootstrap circuit is powered up, the voltage at resistor R4 controls transistor Q9 such that transistor Q9 supplies a current that is two times the current supply by the current mirror of transistors Q4 and Q5, when the bandgap voltage has reached its steady state value of approximately 1.24 volts.

Bootstrap reference circuit 300 of FIG. 4 operates in the same manner as bootstrap reference circuit 200 of FIG. 3. The alternative configuration of transistor Q9 and the use of resistor R5 improve the accuracy of the bandgap reference circuit.

In summary, the bootstrap reference circuit of the present invention employs a peaking current source to provide a reference voltage that has near zero temperature coefficient and improved power supply rejection ratio. Furthermore, the use of a bootstrap current that peaks and starts to decrease prior to the bootstrap reference circuit reaching regulation has the advantage of improving the stability and increasing the speed of the circuit. Lastly, the bootstrap reference circuit of the present invention achieves temperature and process stability by matching the bootstrap current and to the current demand of the shunt regulator across operational temperature and process variations.

The above detailed descriptions are provided to illustrate specific embodiments of the present invention and are not intended to be limiting. Numerous modifications and variations within the scope of the present invention are possible. The present invention is defined by the appended claims.

We claim:

1. A circuit comprising:

a shunt regulator generating a reference voltage at a first node when a supply current is provided to said first node;

a current source generating a current; and a current mirror coupling said current to said first node of said shunt regulator as said supply current of said shunt regulator;

wherein when said shunt regulator is powering up, said current has an increasing magnitude when a voltage at said first node is less than a predefined voltage value, said predefined voltage value being less than said reference voltage; and said current has a decreasing magnitude when said voltage at said first node is greater than said predefined voltage value.

2. The circuit of claim 1, wherein said shunt regulator comprises a bandgap reference circuit and said reference voltage comprises a bandgap voltage.

3. The circuit of claim 1, wherein said predefined voltage value is about 80% of said reference voltage.

4. The circuit of claim 2, wherein said predefined voltage value is 1 volt.

5. The circuit of claim 1, wherein said current source comprises:

a first resistor coupled between said first node and a second node;

a second resistor coupled between said second node and a third node;

a first transistor having a first current handling terminal coupled to said third node, a second current handling terminal coupled to a first supply voltage, and a control terminal coupled to said second node; and a second transistor having a first current handling terminal generating said current, a second current handling terminal coupled to said first supply voltage, and a control terminal coupled to said third node.

6. The circuit of claim 5, wherein said current mirror comprises:

a third transistor having a first current handling terminal and a control terminal both coupled to said first current handling terminal of said second transistor, and a second current handling terminal coupled to a second supply voltage; and a fourth transistor having a first current handling terminal coupled to said first node, a second current handling terminal coupled to said second supply voltage, and a control terminal coupled to said control terminal of said third transistor.

7. The circuit of claim 6, wherein said first and second transistors comprise bipolar transistors and said third and fourth transistors comprise MOS transistors.

8. The circuit of claim 7, wherein said first and second transistors comprise NPN bipolar transistors, and said third and fourth transistors comprise PMOS transistors.

9. The circuit of claim 8, wherein said first supply voltage comprises a ground potential and said second supply voltage comprises a Vcc power supply potential.

10. The circuit of claim 5, wherein said current has a peak current value equal to $V_T/R2$, where $V_T$ is the thermal voltage (kT/q) and R2 is the resistance of said second resistor, and said predefined voltage value is the sum of a voltage at said second node and a voltage across said first resistor at said peak current value.

11. The circuit of claim 2, wherein said bandgap reference circuit comprises:

a first resistor and a second resistor connected in series between said first node and a second node;

a first transistor having a first current handling terminal and a control terminal both coupled to said second node, and a second current handling terminal coupled to a first supply voltage, said first transistor generating a base-to-emitter voltage at said second node; and a differential amplifier comprising a second transistor and a third transistor, said second and third transistors having unequal current densities and generating a $\Delta V_{BE}$ voltage across said second resistor;

wherein said base-to-emitter voltage at said second node is summed with a multiple of said $\Delta V_{BE}$ voltage to generate said bandgap voltage.

12. The circuit of claim 11, wherein said differential amplifier further comprises a current mirror coupled between said first node and said second and third transistors and a fourth transistor coupled to said second and third transistors providing a bias current.

13. The circuit of claim 11, wherein said differential amplifier comprises:

said second transistor having a first current handling terminal coupled to a third node, a second current handling terminal coupled to a fourth node, and a control terminal coupled to an intermediate node between said first and second resistors;

said third transistor having a first current handling terminal coupled to a fifth node, a second current handling terminal coupled to said fourth node, and a control terminal coupled to said second node;

a fourth transistor having a first current handling terminal coupled to said fourth node, a second current handling terminal coupled to said first supply voltage, and a control terminal coupled to said control terminal of said first transistor;

a fifth transistor having a first current handling terminal coupled to said fifth node, a second current handling terminal coupled to said first node, and a control terminal coupled to said third node; and a sixth transistor having a first current handling terminal and a control terminal both coupled to said third node, and a second current handling terminal coupled to said first node.

14. The circuit of claim 11, wherein said differential amplifier comprises:

said second transistor having a first current handling terminal coupled to a third node, a second current handling terminal coupled to a fourth node, and a control terminal coupled to an intermediate node between said first and second resistors;

said third transistor having a first current handling terminal coupled to a fifth node, a second current handling terminal coupled to said fourth node, and a control terminal coupled to said second node;

a resistor coupled between said fourth node and said first supply voltage;

a fourth transistor having a first current handling terminal coupled to said fifth node, a second current handling terminal coupled to said first node, and a control terminal coupled to said third node; and a fifth transistor having a first current handling terminal and a control terminal both coupled to said third node, and a second current handling terminal coupled to said first node.

15. The circuit of claim 11, further comprising:

a fourth transistor having a first current handling terminal coupled to said first node, a second current handling terminal coupled to a sixth node, and a control terminal coupled to an output terminal of said differential amplifier; and a fifth transistor having a first current handling terminal coupled to said sixth node, a second current handling terminal coupled to said first supply voltage, and a control terminal coupled to said control terminal of said first transistor.

16. The circuit of claim 11, further comprising:

a fourth transistor having a first current handling terminal coupled to said first node, a second current handling terminal coupled to a sixth node, and a control terminal coupled to an output terminal of said differential amplifier; and a fifth transistor having a first current handling terminal coupled to said sixth node, a second current handling terminal coupled to said first supply voltage, and a control terminal coupled to said current source and driven by a portion of said current.

17. The circuit of claim 15, further comprising:

a sixth transistor having a first current handling terminal coupled to said first node, a second current handling terminal coupled to said first supply voltage, and a control terminal coupled to said sixth node.

18. The circuit of claim 16, further comprising:

a sixth transistor having a first current handling terminal coupled to said first node, a second current handling terminal coupled to said first supply voltage, and a control terminal coupled to said sixth node.

19. A circuit comprising:

a shunt regulator comprising a bandgap reference circuit generating a bandgap voltage at a first node;

a current source generating a current, said current source comprising:

a first resistor coupled between said first node and a second node;

a second resistor coupled between said second node and a third node;

a first transistor having a first current handling terminal coupled to said third node, a second current handling terminal coupled to a first supply voltage, and a control terminal coupled to said second node; and a second transistor having a first current handling terminal generating said current, a second current handling terminal coupled to said first supply voltage, and a control terminal coupled to said third node; and a current mirror coupling said current to said shunt regulator for supplying said shunt regulator;

wherein when said bandgap reference circuit is powering up, said current has an increasing magnitude when a voltage at said first node is less than a predefined voltage value, said predefined voltage value being less than said bandgap voltage; and said current has a decreasing magnitude when said voltage at said first node is greater than said predefined voltage value.

20. The circuit of claim 19, wherein said predefined voltage value is 1 volt.

21. The circuit of claim 19, wherein said current has a peak current value equal to $V_T/R2$, where $V_T$ is the thermal voltage (kT/q) and R2 is the resistance of said second resistor, and said predefined voltage value is the sum of a voltage at said second node and a voltage across said first resistor at said peak current value.

22. A method for generating a reference voltage, comprising:

providing a shunt regulator including a bandgap reference circuit for generating a bandgap voltage at a first node when a supply current is provided to said first node;

providing an increasing current at said first node for supplying said supply current of said shunt regulator when said shunt regulator is powering up; and when the voltage generated by said shunt regulator at said first node reaches a predefined voltage value less than said bandgap voltage, providing a decreasing current for supplying said supply current of said bandgap reference circuit.

* * * * *